US006503070B2

(12) United States Patent
Eiermann

(10) Patent No.: US 6,503,070 B2
(45) Date of Patent: Jan. 7, 2003

(54) ROTARY PISTON ENGINE HAVING AN OIL SYSTEM FOR LUBRICATION AND COOLING

(75) Inventor: Dankwart Eiermann, Weissenberg (DE)

(73) Assignee: Brandenburgische Forschungs-und Entwicklungsgesellschaft Cottbus mbH, Cottbus (DE)

( * ) Notice: Subject to any disclaimer, the term of this patent is extended or adjusted under 35 U.S.C. 154(b) by 0 days.

(21) Appl. No.: 09/866,484

(22) Filed: May 29, 2001

(65) Prior Publication Data

US 2002/0015652 A1 Feb. 7, 2002

(30) Foreign Application Priority Data

May 27, 2000 (DE) ..... 100 26 449

(51) Int. Cl.[7] ..... F01C 21/04; F01C 21/06

(52) U.S. Cl. ..... 418/83; 418/1; 418/88; 418/101

(58) Field of Search ..... 418/1, 61.2, 83, 418/88, 101

(56) References Cited

U.S. PATENT DOCUMENTS 3,102,516 A * 9/1963 Gist et al. ..... 418/83
3,196,855 A * 7/1965 Jones ..... 418/101
4,037,999 A * 7/1977 Armin et al. ..... 418/88

* cited by examiner

*Primary Examiner*—John J. Vrablik
(74) *Attorney, Agent, or Firm*—Crowell & Moring LLP

(57) ABSTRACT

A trochoidal design rotary piston engine design has a rotary piston housing with a double curve inner contour and triangular type rotary pistons. Sliding bearings distribute lubricating oil from a pressure cycle into a high pressure circuit and a low pressure bypass circuit branches to the side parts and axial cooling channels of the rotary piston housing to supply the cooling oil.

25 Claims, 4 Drawing Sheets

ROTARY PISTON ENGINE HAVING AN OIL SYSTEM FOR LUBRICATION AND COOLING

BACKGROUND OF THE INVENTION

This application claims the priority of German application 100 26 449.2, filed May 27, 2000, the disclosure of which is expressly incorporated by reference herein.

This invention refers to a trochoidal design rotary piston engine with a rotary piston housing, two side disks, one of the eccentric shafts bearing-mounted in the side disks, a rotary piston, and an eccentric cam bearing-mounted eccentric shaft with a pressure oil supply unit for supplying oil to the side disk, the bearings and the rotary piston bearing of the eccentric shaft.

Many models of the above-noted rotary piston engine designs are known, for example, from the German Pat. Document No. DE-C 40 03 663 (corresponding U.S. Pat. No. 5,199,863) and are also being serially produced. These types of engines are generally equipped with a fluid cooling system necessary for the peripheral heat exchangers and lines. This supplemental equipment and the cooling fluid will nearly double the total weight of the unit compared to a net engine weight. With the known weight optimizing construction with a performance range of up to approximately 100 kW, the system specific weight is approximately 1 kg/kW or better. A reduction in the system specific weight would be desirable for the use of such engines in aviation operations. Additionally, a demand on the modern engines, in addition to a high specific performance is also a highest possible efficiency. Furthermore, the possibility of supercharging the engine for multi-fuel operations should be available, especially in the shift charging process. This supercharging leads to increased combustion chamber pressures and is linked to high local temperature loading. A weight favorable air-cooling by itself could not meet these demands.

An object of this invention is to accomplish the task of producing an above-described rotary piston engine with lowest possible specific system weight ratio.

This object has been achieved according to preferred embodiments of the invention in that the pressure oil supply system splits the low pressure line leading to the side disks and rotary piston housing cooling channels which are connected to the re-circulation of the pressure oil supply system.

According to certain preferred embodiments of this invention, the bearing lubrication and the pressure oil needed for the cooling of the piston is also used to cool the rotary piston housing and the side disks. That saves on the need for a coolant cooling separator with attendant lines so that the system weight can be reduced accordingly.

It has been foreseen in certain preferred embodiments of the invention design that the low-pressure line would be connected to both side disks whose cooling channels are linked to the axial cooling channels of the rotary piston housing. Thus it has been advantageously anticipated that the side disks cooling channels will be designed in such a way that the oil supplied to one side disk will be delivered, after flowing through the cooling channels of the rotary piston housing, to the other side disk. That provides for a very effective cooling of the side disks and the rotary piston housing.

In a further design feature of certain preferred embodiments of the invention, it is intended that the rotary piston housing will have an angle range of about 90 degrees in the direction of the motion toward the exhaust pipe and is equipped with axial cooling channels. In the practice, it will mostly suffice to cool only this area with oil, since it is subjected to the highest heat load.

For practical purposes, it is provided in certain preferred embodiments of the invention that the pressure oil supply system will include an oil pump with at least twice the capacity requirements of the oil quantity required for lubrication of the bearings. That ensures that a sufficiently large quantity of cooling oil will be supplied by the low-pressure branch of the oil cycle.

In order to further reduce the engine load, it has been additionally established according to certain preferred embodiments of the invention that the rotary piston housing would be equipped with cooling ribs over an angular range of about 90 degrees in the direction of the motion toward the exhaust pipe.

Other objects, advantages and novel features of the present invention will become apparent from the following detailed description of the invention when considered in conjunction with the accompanying drawings.

DETAILED DESCRIPTION OF THE PREFERRED EMBODIMENTS

Figure 1:
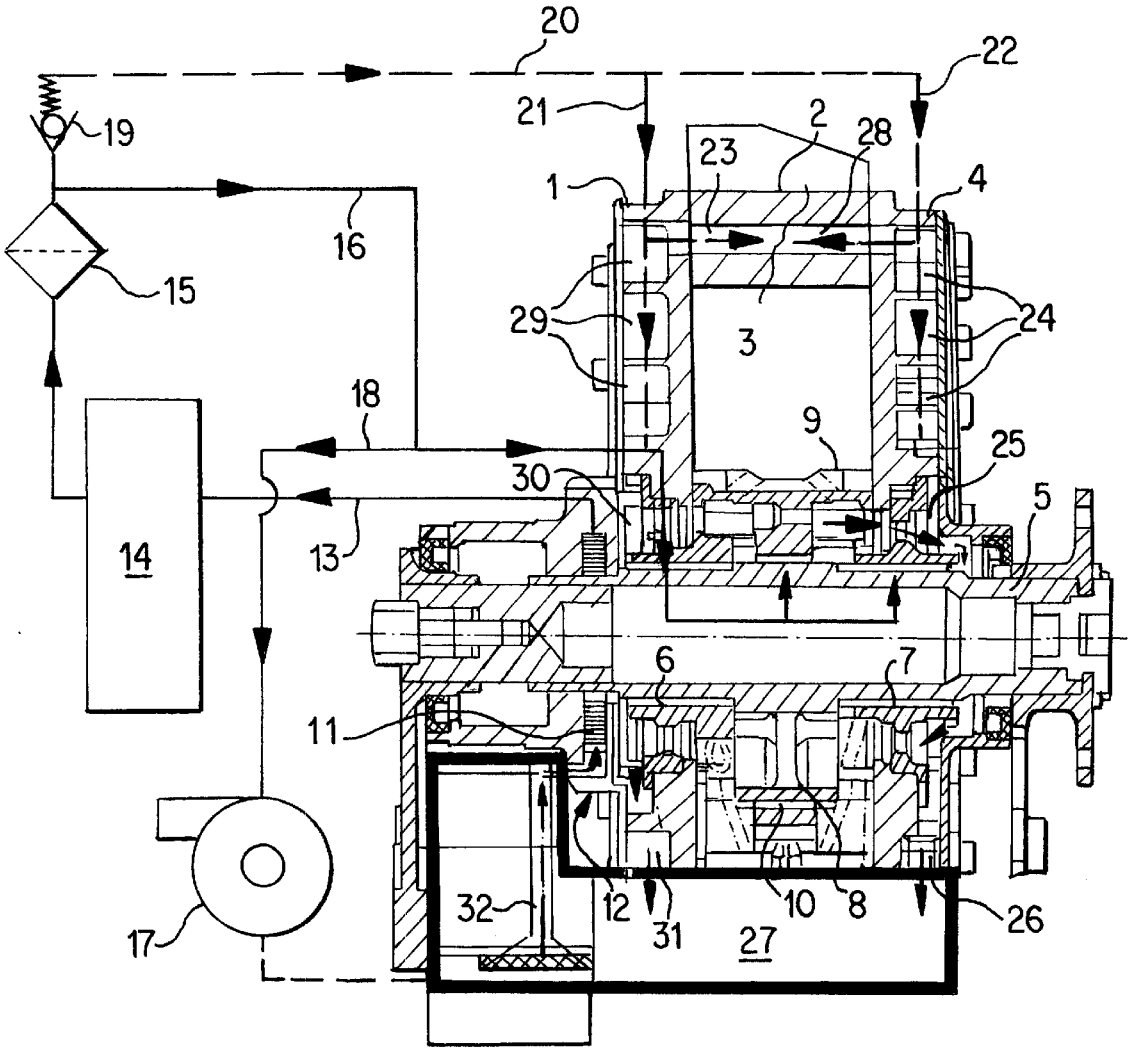
FIG. 1 shows an axial section of a rotary piston engine with a schematic representation of the combined lubrication and cooling oil cycle, constructed according to a preferred embodiment of the present invention.
Figure 2:
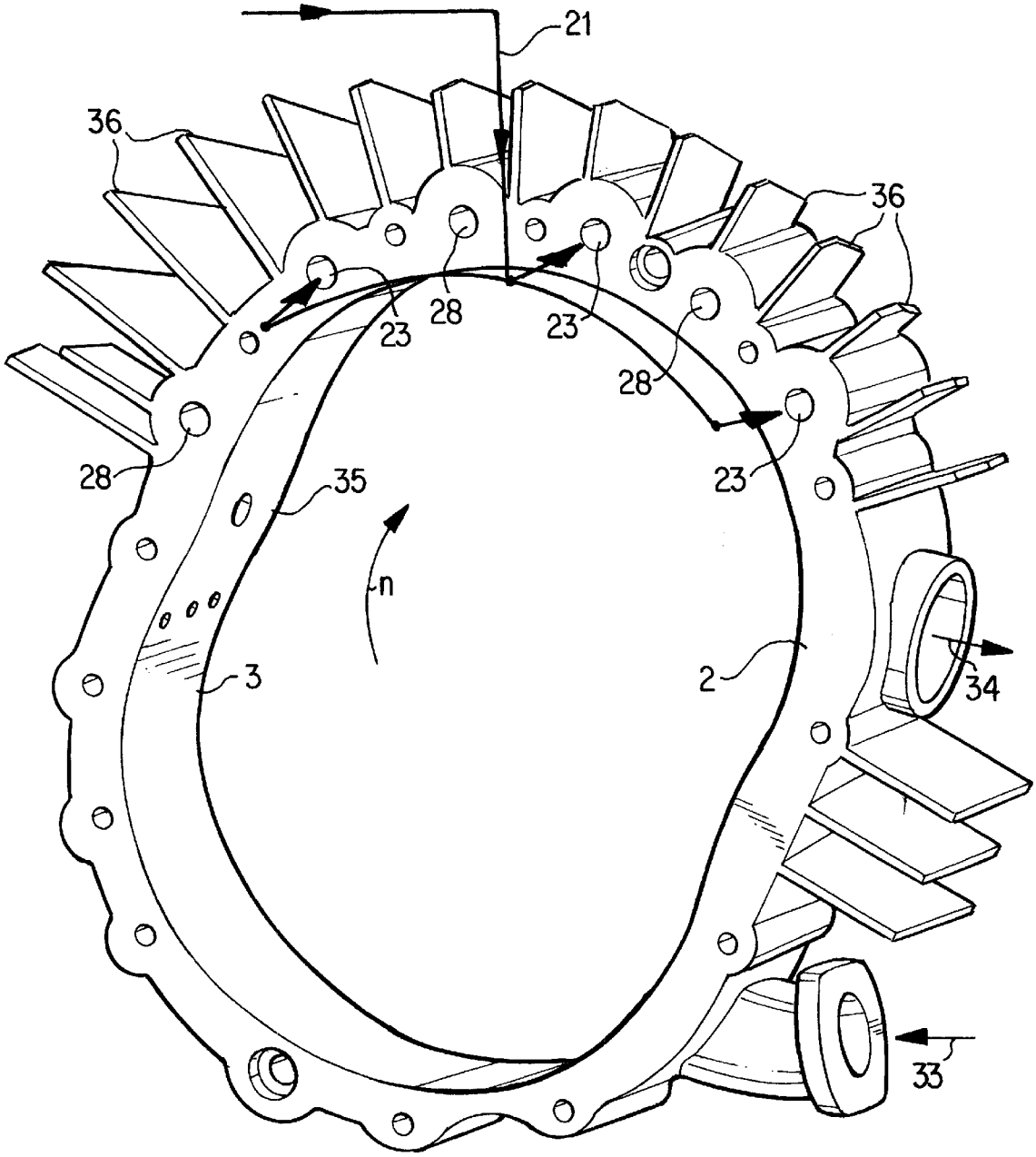
FIG. 2 shows a perspective view of a rotary piston housing of the rotary piston engine according to FIG. 1.
Figure 3:
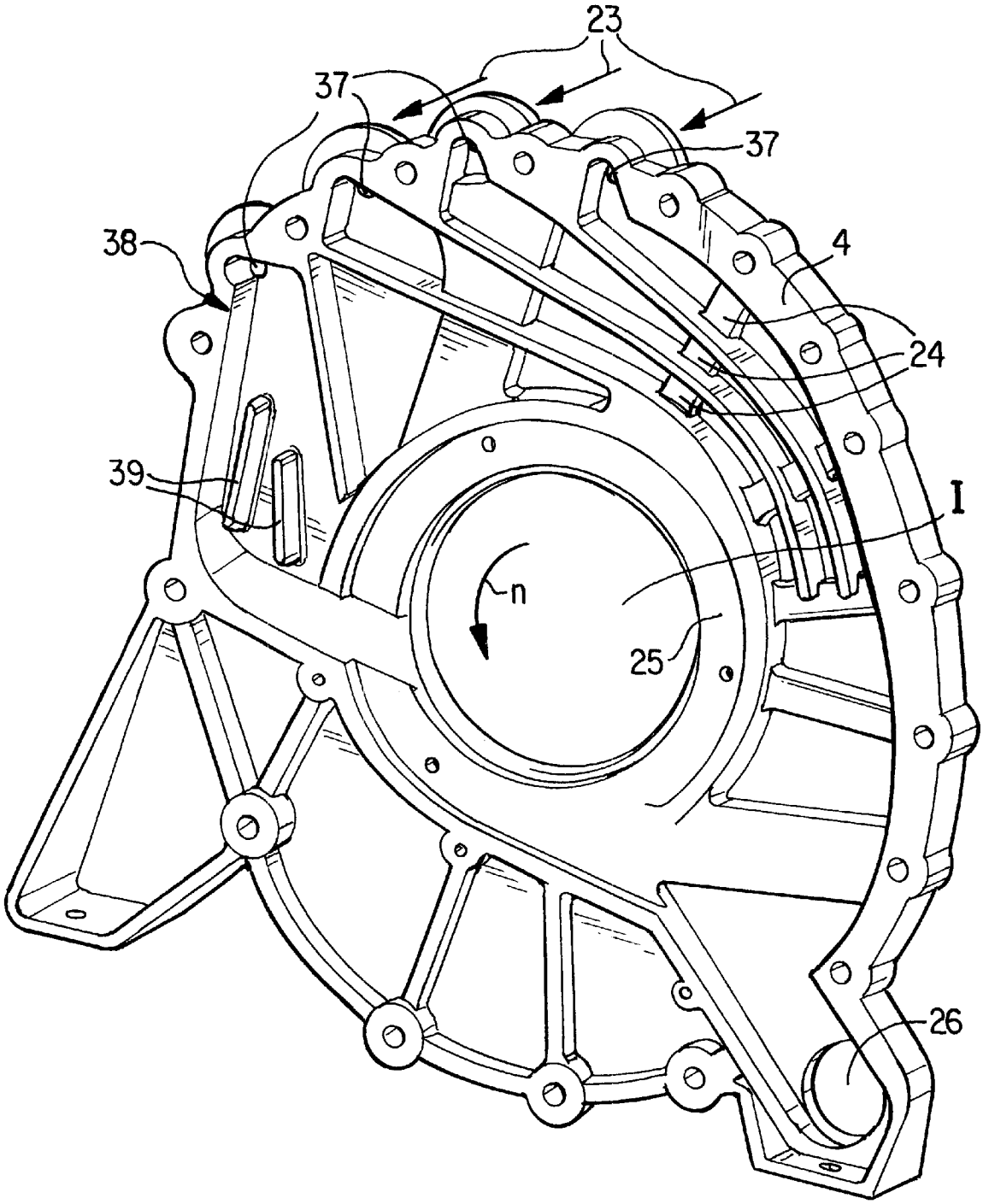
FIG. 3 shows a perspective view of the output side associated side disk.

The rotary piston engine represented in FIGS. 1 through 3 is also the subject of parallel patent applications filed in Germany on May 27, 2000, with respective German patent application numbers 100 26 447.6 and 100 26 448.4. The contents of corresponding U.S. application Ser. Nos. 09/866,467 and 09/866,466, filed May 29, 2001, are incorporated herein by reference thereto to aid in an understanding of the present invention.

The housing shown in the FIG. 1 of the represented rotary piston engine has a side part or side disk 1, a rotary piston housing 2 with a double arched trochoid design track casing 3, and an output side mounted side disk 4 or a side section. An eccentric shaft 5 is seated in the side disks 1 and 4 by means of sliding bearings 6 and 7. On the eccentric cam 8 of the eccentric shaft 5 is a triangular design rotary piston 9 seated on one of the eccentric sliding bearings 10. The piston is linked by a synchronization drive, as the principle is known from the German Pat. Document No. DE-C 40 03 663, with the eccentric shaft (5).

An external cogwheel 11 of an external cogwheel oil pump 12, which is not shown in greater detail, meshes with a pump cogwheel 11*a* of a significantly greater diameter than the drive cogwheel 11, and is mounted on the eccentric shaft 5. The external cogwheel oil pump supplies oil under pressure through a pressure line 13 and then through an oil heat exchanger 14 and an oil filter 15. From the oil filter 15, a pressure line 16 leads to the lubricating oil supply of the sliding bearing 6 and 7 and the eccentric shaft 5, and to the sliding bearing 10 of the oil cooled rotary piston 9.

Figure 4:
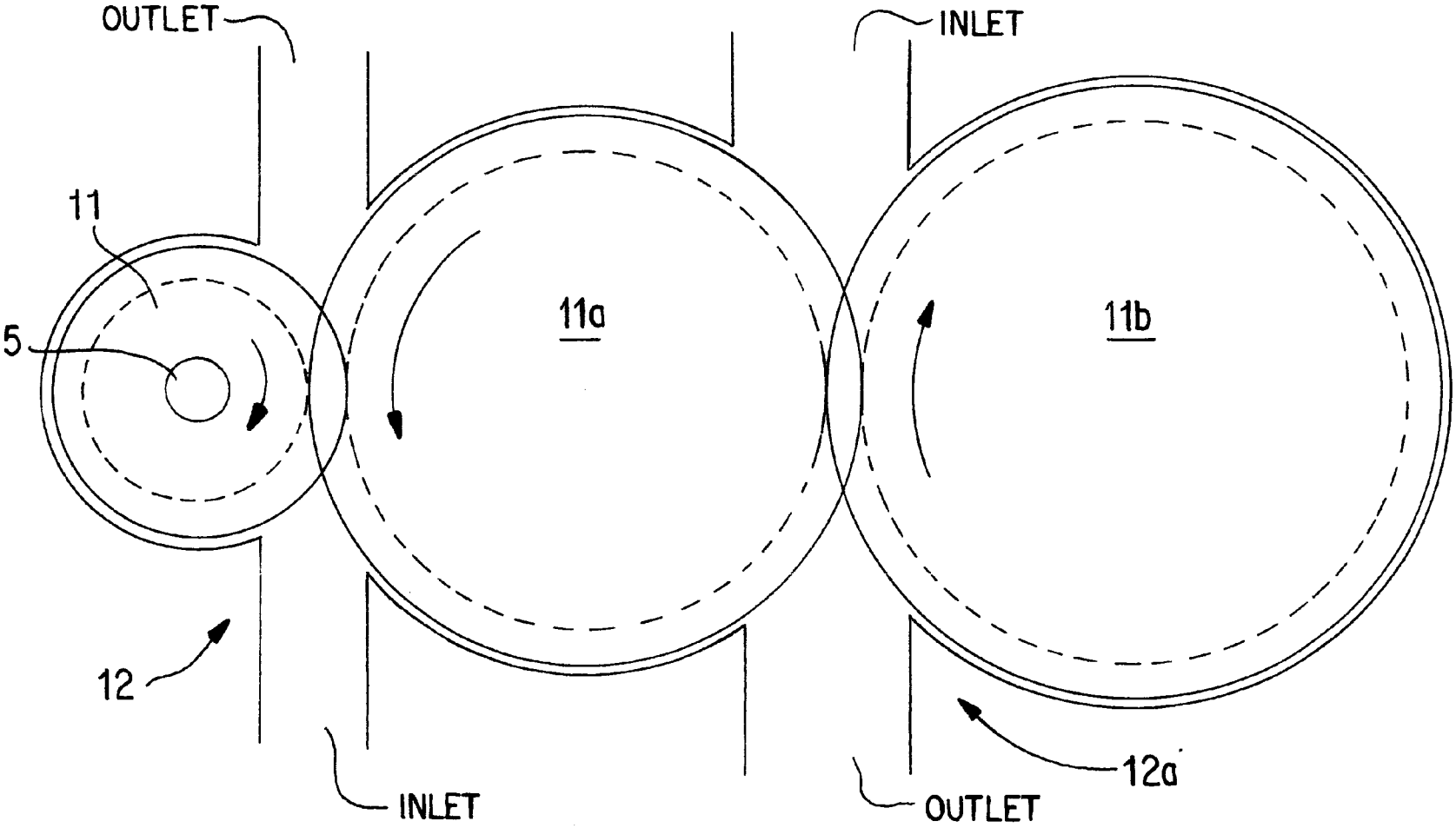
FIG. 4 shows three cogwheels forming a paired pump.

Alternatively, as described in the incorporated German and U.S. patent applications and shown in FIG. 4, three cogwheels 11, 11*a*, 11*b* may be provided. The three cogwheels 11, 11*a*, 11*b* provide a paired pump 12, 12*a*. The first pair of cogwheels 11, 11*a* forms a first part 12 of the paired pump, and the second pair of cogwheels 11*a*, 11*b* forms a second part 12*a* of the pair pump. The paired pump 12, 12*a* is used to supply oil under pressure through the pressure line 13.

A bypass pressure line 18 branches from the pressure line 16 to the exhaust turbo loader 17. Another line from the exhaust turbo loader 17 leads to an oil collection container 27 to which the oil moving through the slide bearing 6, 7, and 10 is also re-circulated.

A low-pressure line with an installed pressure control valve 19 branches off from the pressure line 16 after the oil filter 15. The control pressure valve 19 ensures that the oil pressure in the pressure line 16 is limited to a maximum value which, as an example, is at 4 Bars, although, the external cogwheel oil pump 12 supplies twice as much or greater quantity of oil then is necessary for lubricating the sliding bearings 6, 7, and 10. The excess oil pressure is then lowered at the pressure control valve 19 and re-circulated over the low pressure line 20 to the rotary piston engine housing.

The low-pressure line 20 is separated by the splitter 21, 22 and supplied at the highest point to the side disks 1, 4. The oil supplied through the splitter line 21 to the side disk 1 is bypassed from there in the axial bores 23 from whence it flows to the side disk 4 on the opposite side. Within the side disk 4, it flows through several cooling channels 24, 38 to the ring chamber 25 surrounding the glide bearing 7 and then to an oil re-circulation line 26 leading to the oil container 27. The side part 4 is made of two parts and consists of a basic element, which preferably has been made as a cast, and a radial inner walling, inclined toward the rotary piston 9 and is provided on the outside with ribs which run around the ring chamber to the oil re-circulation line 26. The oil supplied to the area of the exhaust pipe 34 flows through channel 38 to the ring chamber 25 and thence to the oil re-circulation 26. The channel 38 is installed in the area of the exhaust pipe exit and provided with inner lead ribs 39.

Correspondingly, cooling oil is supplied to the side disk 4 through the branch line 22, thence, over the axial cooling channels 37 of the rotary piston housing 2 through corresponding channels 29 to a ring-form cavity 30 and to the oil re-circulation 31.

FIG. 2 shows a perspective view of the rotary piston housing 2 with the trochoidal design casing track and also shows the installation of the intake opening 33 and the outflow opening 34. The turning direction of the rotary piston 9, not shown in FIG. 2, is indicated by an arrow n. Extending from the dip 35 to the outflow opening 34 is the so-called warm curve of about 90 degrees of the rotary piston housing 2. In this area, the oil cooling takes place and is then supplied over the low pressure line 20 to the branch line point 21, 22. Furthermore, located in the area of the warm curve is the rotary piston housing of the axially arranged outer side cooling ribs 36 to provide for additional air cooling.

FIG. 3 is a perspective view of the output side arranged side disk 4, that is, the basic element of this side disk 4 without the cover disk. The outflow openings 37 are part of the axial cooling bores or cooling channels 23 of the rotary piston housing 2 and lead to the essentially concentrically arranged cooling channels 24 around the ring-form cavity 25. The direction of the flow of the cooling oil is here in opposite direction of the rotary piston 9 rotation. The additional cooling channel 38, in which the oil flows through in the direction of the rotary piston 9 occurs, is provided with leading ribs 39. The cooling channel 39 as well as the cooling channels 24 leads to the oil re-circulation 26.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A trochoidal design rotary piston engine comprising:

a rotary piston housing;

two side disks;

a side disk bearing-mounted eccentric shaft and a rotary piston which is bearing-mounted on an eccentric cam of the eccentric shaft; and only one cooling and lubrication circuit including a pressure oil supply system, a first line connecting the pressure oil supply system to bearings in the side disks and bearing of the rotary piston on the eccentric cam, and a valve-controlled low pressure line connecting the first line of the pressure oil supply system to cooling channels of the side disks and the rotary piston housing.

2. The rotary piston engine according to claim 1, wherein the pressure oil supply system includes only one oil pump with a supply capacity that is at least twice that of a bearing lubrication required oil quantity.

3. The rotary piston engine according to claim 1, wherein the rotary piston housing is provided with outside cooling ribs with an angular range of 90 degrees in a direction of the rotation (n) of the rotary piston before an exhaust pipe opening.

4. The rotary piston engine according to claim 1, wherein three successive cogwheels are provided, which form a paired oil pump.

5. The rotary piston engine according to claim 1, wherein the low pressure line is connected to both side disks whose cooling channels are linked to the cooling channels of the rotary piston housing.

6. The rotary piston engine according to claim 5, wherein the cooling channels in the side disks are arranged in such a way that the oil supplied to one side disk will be removed after flowing through the cooling channels of the rotary piston housing in the other side disk.

7. The rotary piston engine according to claim 5, wherein the rotary piston housing is provided with axial cooling channels before an exhaust pipe opening over an angular range of about 90 degrees in a direction of piston rotation.

8. The rotary piston engine according to claim 5, wherein the side disks are provided with ribs running essentially in a perimeter direction of the averted rotary piston housing side which, together with cover cooling channels are arranged counter to a rotation direction of the rotary piston.

9. The rotary piston engine according to claim 5, wherein the pressure oil supply system includes only one oil pump with a supply capacity that is at least twice that of a bearing lubrication required oil quantity.

10. The rotary piston engine according to claim 5, wherein the rotary piston housing is provided with outside cooling ribs with an angular range of 90 degrees in a direction of the rotation (n) of the rotary piston before an exhaust pipe opening.

11. The rotary piston engine according to claim 1, wherein the cooling channels in the side disks are arranged in such a way that the oil supplied to one side disk will be removed after flowing through the cooling channels of the rotary piston housing in the other side disk.

12. The rotary piston engine according to claim 11, wherein the rotary piston housing is provided with axial cooling channels before an exhaust pipe opening over an angular range of about 90 degrees in a direction of piston rotation.

13. The rotary piston engine according to claim 11, wherein the side disks are provided with ribs running essentially in a perimeter direction of the averted rotary piston housing side which, together with cover cooling channels are arranged counter to a rotation direction of the rotary piston.

14. The rotary piston engine according to claim 11, wherein the pressure oil supply system includes only one oil pump with a supply capacity that is at least twice that of a bearing lubrication required oil quantity.

15. The rotary piston engine according to claim 11, wherein the rotary piston housing is provided with outside cooling ribs with an angular range of 90 degrees in a direction of the rotation (n) of the rotary piston before an exhaust pipe opening.

16. The rotary piston engine according to claim 1, wherein the rotary piston housing is provided with axial cooling channels before an exhaust pipe opening over an angular range of about 90 degrees in a direction of piston rotation.

17. The rotary piston engine according to claim 16, wherein the pressure oil supply system includes only one oil pump with a supply capacity that is at least twice that of a bearing lubrication required oil quantity.

18. The rotary piston engine according to claim 16, wherein the rotary piston housing is provided with outside cooling ribs with an angular range of 90 degrees in a direction of the rotation (n) of the rotary piston before the exhaust pipe opening.

19. The rotary piston engine according to claim 16, wherein the side disks are provided with ribs running essentially in a perimeter direction of the averted rotary piston housing side which, together with cover cooling channels are arranged counter to a rotation direction of the rotary piston.

20. The rotary piston engine according to claim 19, wherein the rotary piston housing is provided with outside cooling ribs with an angular range of 90 degrees in a direction of the rotation (n) of the rotary piston before the exhaust pipe opening.

21. The rotary piston engine according to claim 1, wherein the side disks are provided with ribs running essentially in a perimeter direction of the averted rotary piston housing side which, together with cover cooling channels are arranged counter to a rotation direction of the rotary piston.

22. The rotary piston engine according to claim 21, wherein the pressure oil supply system includes only one oil pump with a supply capacity that is at least twice that of a bearing lubrication required oil quantity.

23. A method of operating a rotary piston engine having a rotary piston housing clamped between two side disks to form a combustion chamber, said method comprising:

providing only one cooling and lubrication circuit;

supplying high pressure lubricating oil via a high pressure line of the cooling and lubrication circuit to lubricating spaces in said bearings in the side disks and bearing of the rotary piston on the eccentric cam, and branching off a portion of the lubricating oil via a valve-controlled low pressure line connected with the high pressure line and supplying the lubricating oil in the low pressure line as cooling oil to cooling spaces in the side disks and housing.

24. A method of operating a rotary piston engine according to claim 23, wherein said supplying high pressure lubricating oil to the high pressure line includes supplying at least twice a predetermined capacity used for lubricating.

25. A method according to claim 23, wherein the cooling and lubrication circuit includes only one pump.

* * * * *